US010663150B1

(12) United States Patent
Luna et al.

(10) Patent No.: US 10,663,150 B1
(45) Date of Patent: May 26, 2020

(54) HANDS-FREE FOREARM FLASHLIGHT HAVING A BASE WITH HINGE AND LIGHT PANEL COUPLED TO HINGE WITH STRAP COUPLED TO THE BASE

(71) Applicants: Phillip Luna, Oxnard, CA (US); Roxanne Luna, Oxnard, CA (US)

(72) Inventors: Phillip Luna, Oxnard, CA (US); Roxanne Luna, Oxnard, CA (US)

( * ) Notice: Subject to any disclaimer, the term of this patent is extended or adjusted under 35 U.S.C. 154(b) by 0 days.

(21) Appl. No.: 16/451,252

(22) Filed: Jun. 25, 2019

(51) Int. Cl.

| | |
|---|---|
| ***F21V 21/14*** | (2006.01) |
| ***F21V 21/30*** | (2006.01) |
| ***F21L 4/00*** | (2006.01) |
| ***A45F 5/00*** | (2006.01) |
| *F21Y 115/10* | (2016.01) |
| *F21Y 113/00* | (2016.01) |

(52) U.S. Cl.
CPC ..... *F21V 21/145* (2013.01); *A45F 5/00* (2013.01); *F21L 4/005* (2013.01); *F21V 21/30* (2013.01); *A45F 2005/008* (2013.01); *F21Y 2113/00* (2013.01); *F21Y 2115/10* (2016.08)

(58) Field of Classification Search
CPC .... F21Y 2107/90; F21V 21/145; F21V 21/30; A45F 2005/008; F21L 4/027; F21L 4/022
See application file for complete search history.

(56) References Cited

U.S. PATENT DOCUMENTS

| | | | | |
|---|---|---|---|---|
| 3,112,889 | A | 12/1963 | Marmo | |
| 5,154,506 | A | 10/1992 | Leard | |
| 5,738,432 | A * | 4/1998 | Okko | A43B 1/0036 362/103 |
| 5,752,633 | A * | 5/1998 | Antaki | A45F 5/00 224/222 |
| 6,062,447 | A | 5/2000 | Longley | |
| 6,869,201 | B2 | 3/2005 | Kruger | |
| D675,011 | S | 1/2013 | Stiefel | |
| 8,975,606 | B2 | 3/2015 | Bowers | |
| D735,988 | S | 8/2015 | Hull | |
| 9,155,168 | B2 | 10/2015 | Araujo | |
| 2012/0307506 | A1* | 12/2012 | Gunn | F21L 4/005 362/382 |

FOREIGN PATENT DOCUMENTS

WO WO2012075292 6/2012

* cited by examiner

*Primary Examiner* — Robert J May

(57) ABSTRACT

A hands-free forearm flashlight for hands-free illumination includes a base having a distal end, a proximal end, a dorsal side, a ventral side, a lateral side, and a medial side. A strap extends from the lateral side to the medial side. A hinge is coupled to the proximal end of the base and to a bottom side of a light panel, allowing the light panel to swingably move between a closed position touching the base and an alternate open position perpendicular to the base. A plurality of lights is coupled to the light panel and comprises a front light matrix coupled to a bottom side and a rear light matrix coupled to a top side. A power switch is coupled to the base to separately activate and alternatively deactivate each of the front light matrix and the rear light matrix.

15 Claims, 8 Drawing Sheets

HANDS-FREE FOREARM FLASHLIGHT HAVING A BASE WITH HINGE AND LIGHT PANEL COUPLED TO HINGE WITH STRAP COUPLED TO THE BASE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to flashlights and more particularly pertains to a new flashlight for hands-free illumination.

BRIEF SUMMARY OF THE INVENTION

An embodiment of the disclosure meets the needs presented above by generally comprising a base having a distal end, a proximal end, a dorsal side, a ventral side, a lateral side, and a medial side. A strap is coupled to the base and extends from the lateral side to the medial side. The strap is configured to secure the base to a forearm of a user. A hinge is coupled to the proximal end of the base adjacent the dorsal side. A light panel has a front end, a rear end, a top side, a bottom side, a right side, and a left side. The rear end is coupled to the hinge allowing the light panel to swingably move between a closed position touching the base and an alternate open position perpendicular to the base. A plurality of lights is coupled to the light panel. The plurality of lights comprises a front light matrix coupled to the bottom side and a rear light matrix coupled to the top side. A power supply is coupled to the light panel between the top side and the bottom side. The power supply is in operational communication with the plurality of lights. A power switch is coupled to the base and is in operational communication with the power supply and each of the front light matrix and the rear light matrix. The power switch separately activates and alternatively deactivates each of the front light matrix and the rear light matrix.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
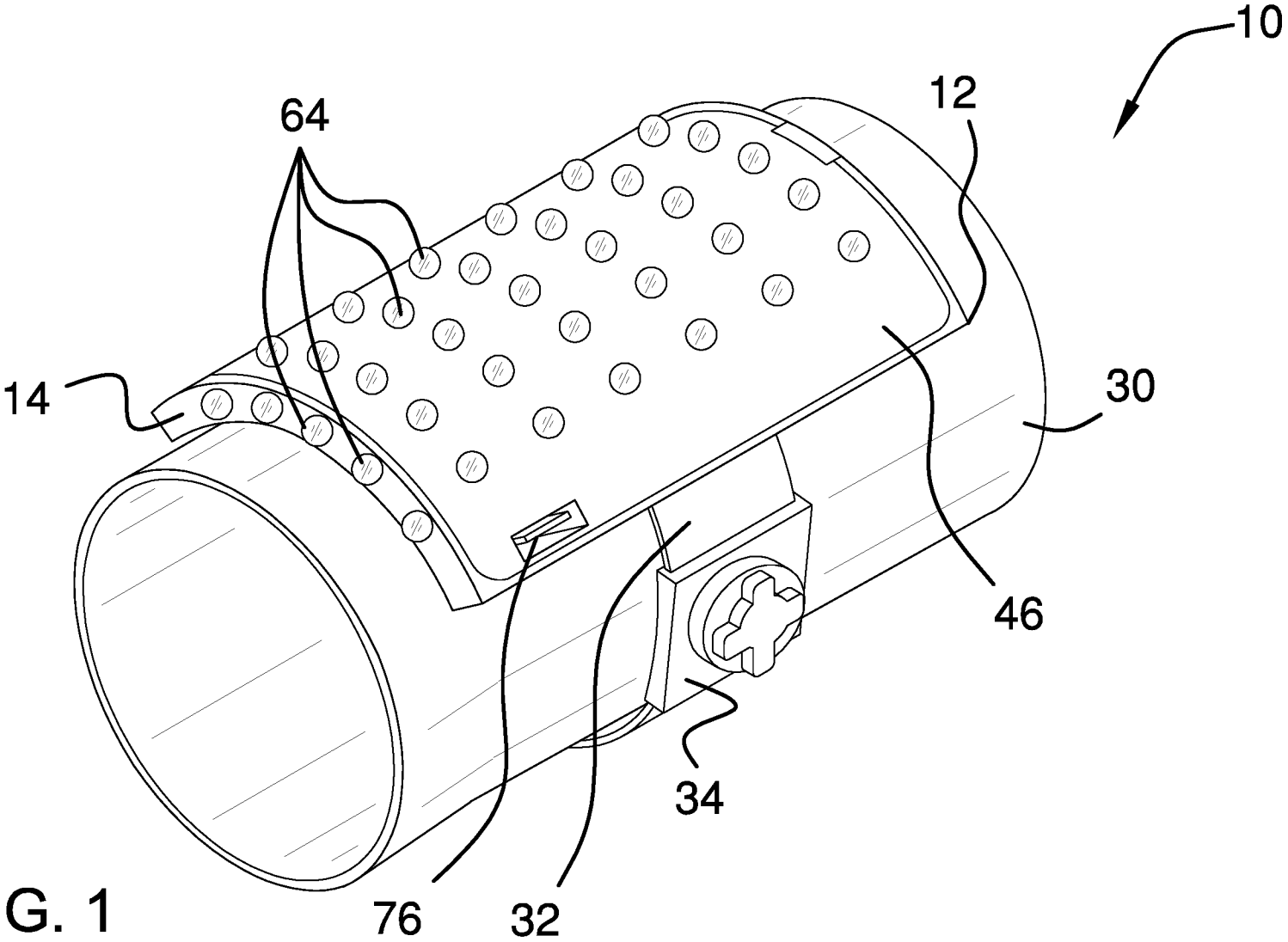
FIG. 1 is an isometric view of a hands-free forearm flashlight according to an embodiment of the disclosure.
Figure 2:
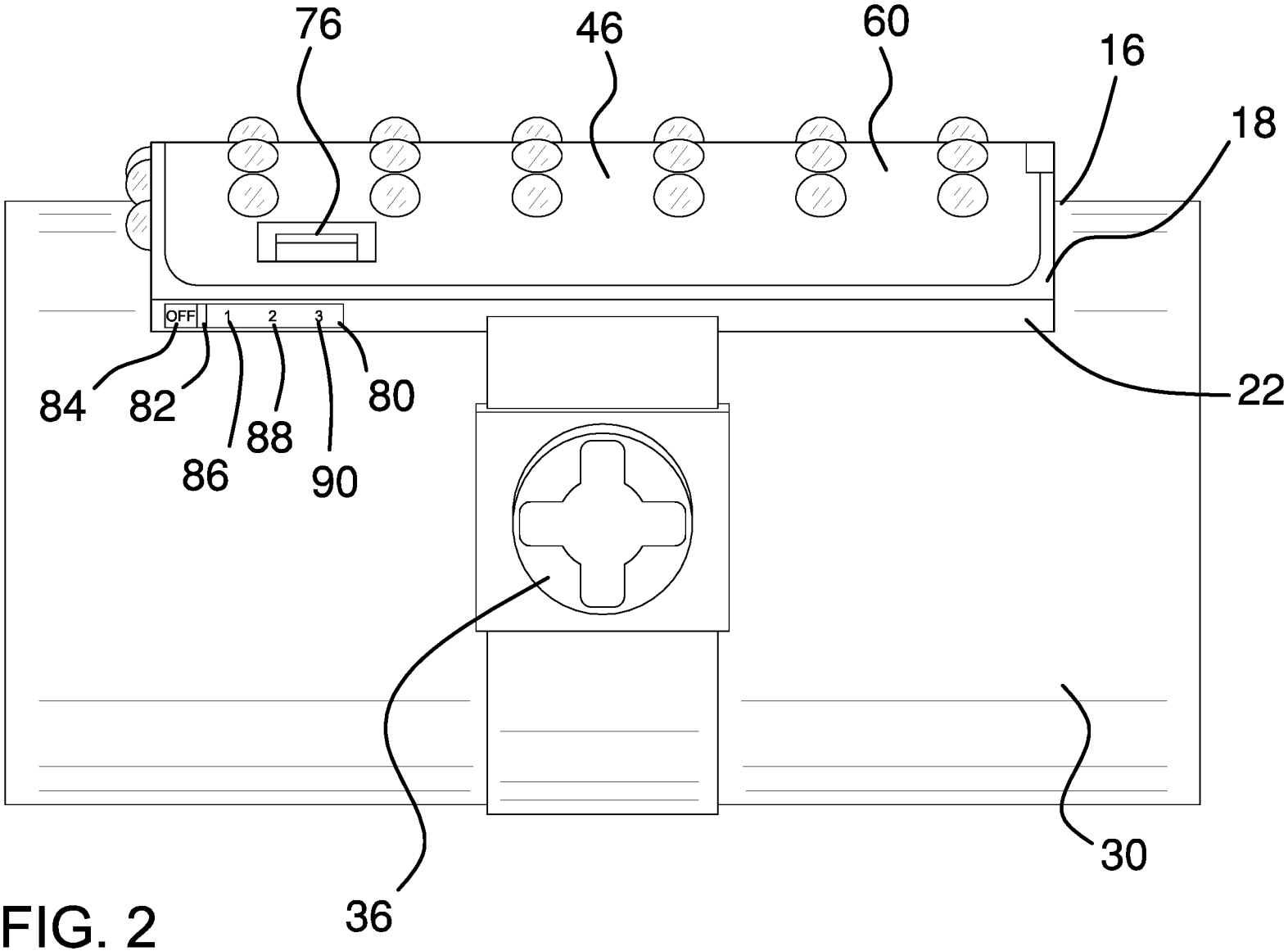
FIG. 2 is a side elevation view of an embodiment of the disclosure.
Figure 3:
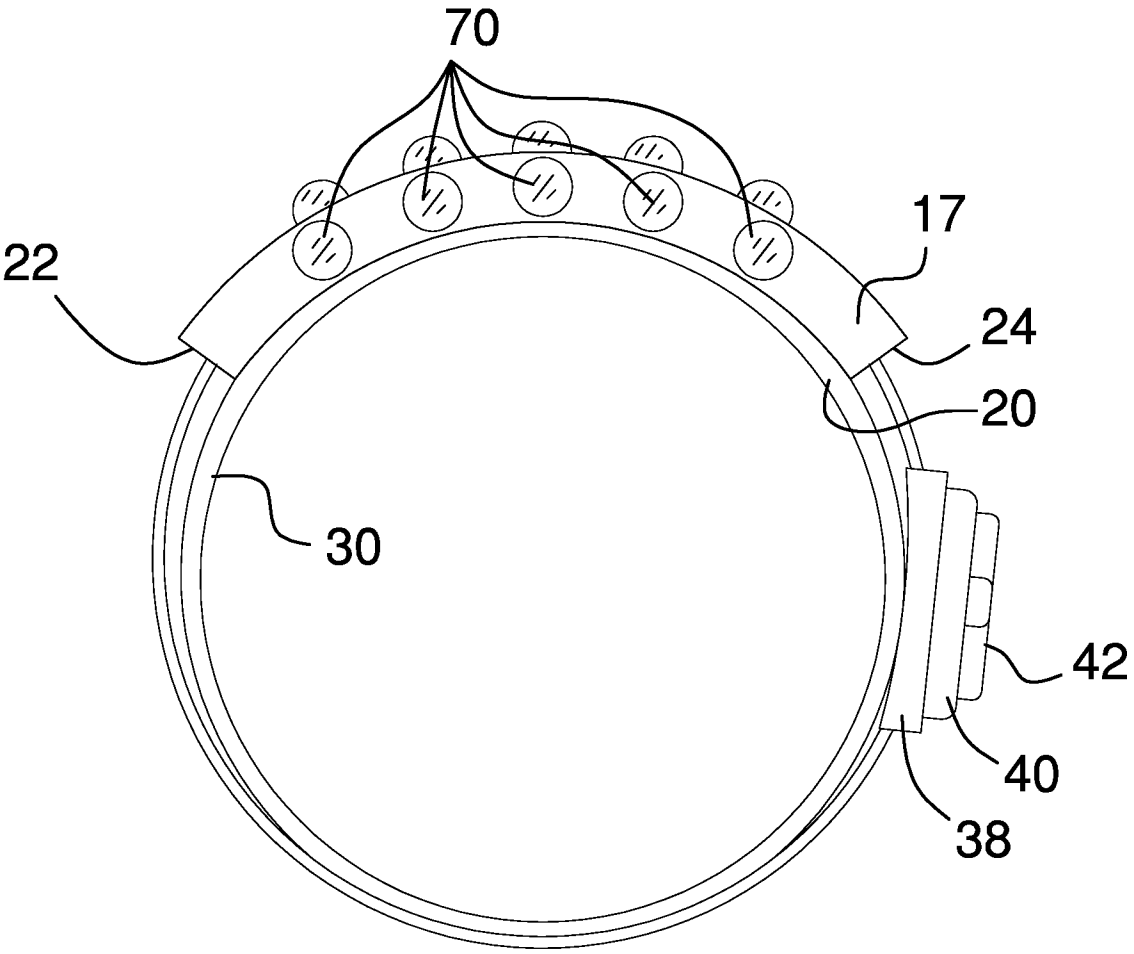
FIG. 3 is a front elevation view of an embodiment of the disclosure.
Figure 4:
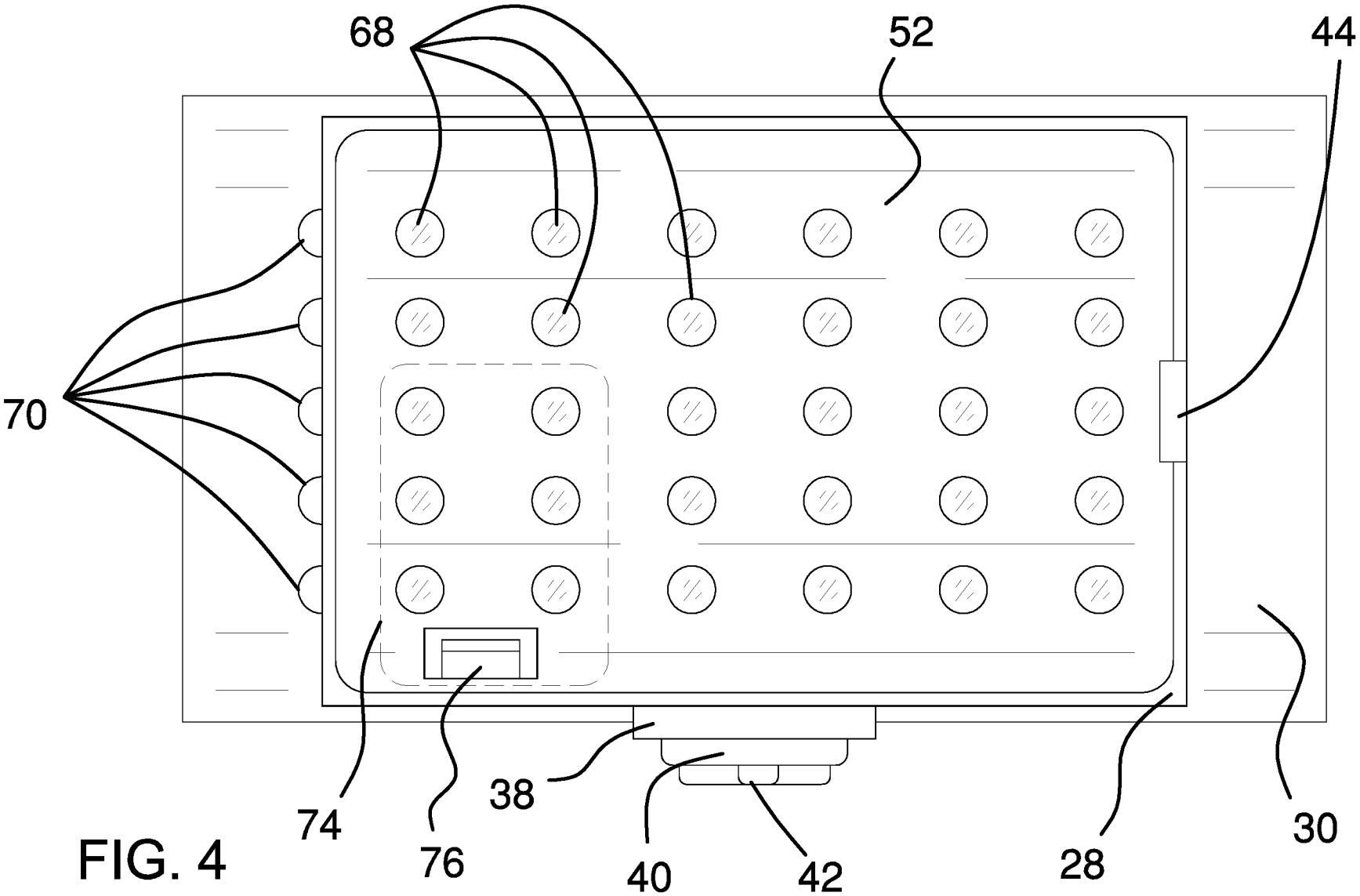
FIG. 4 is a top plan view of an embodiment of the disclosure.
Figure 5:
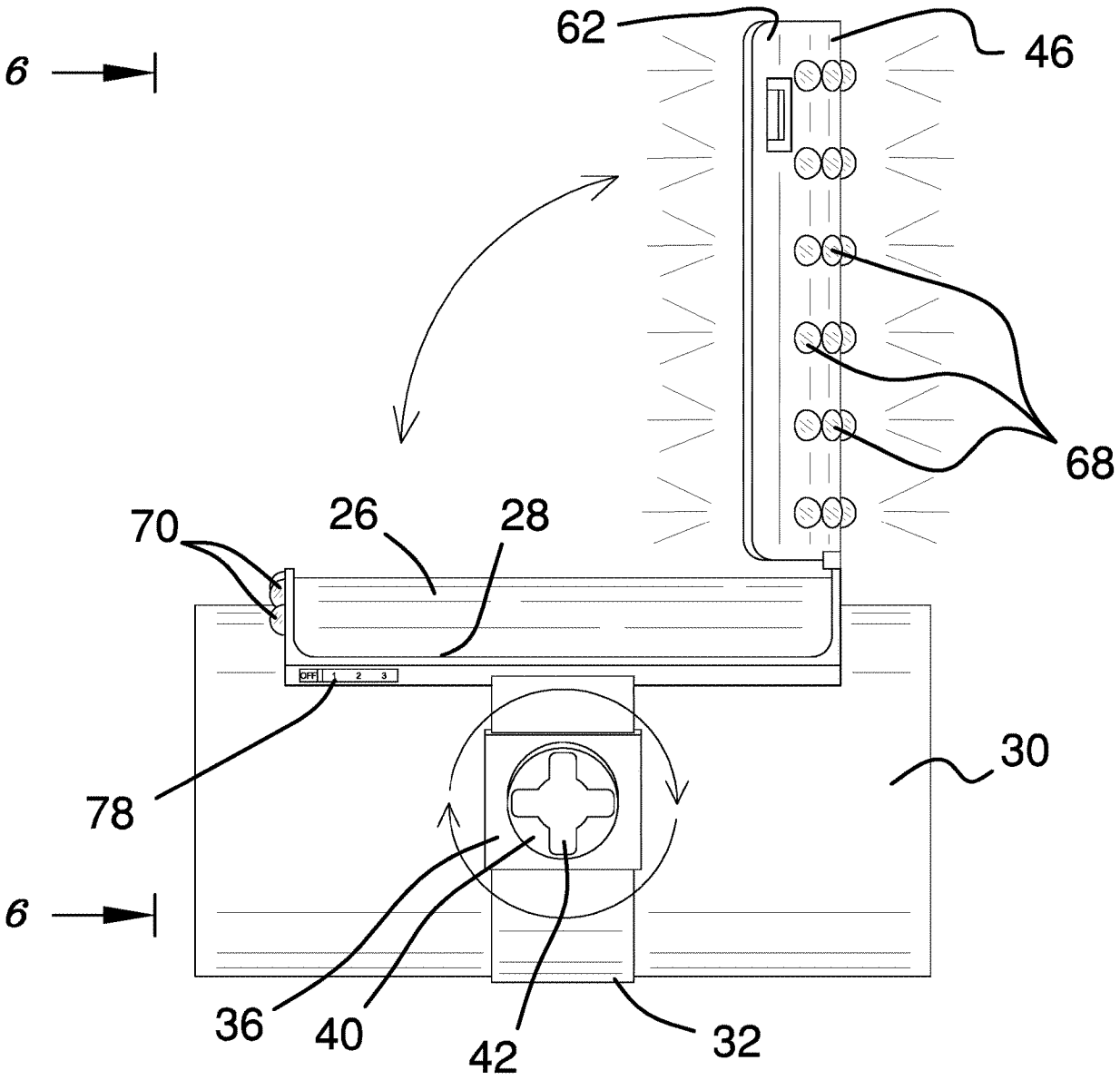
FIG. 5 is an in-use view of an embodiment of the disclosure.
Figure 6:
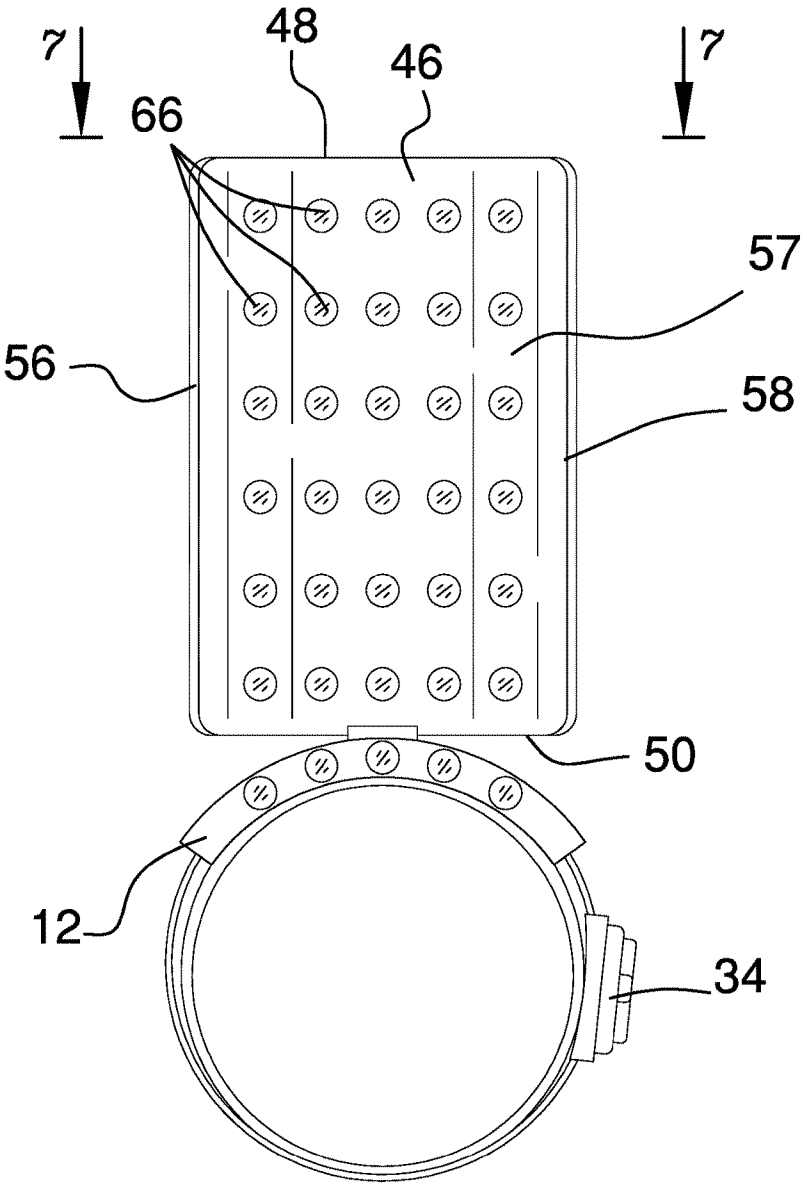
FIG. 6 is an in-use view of an embodiment of the disclosure.
Figure 7:
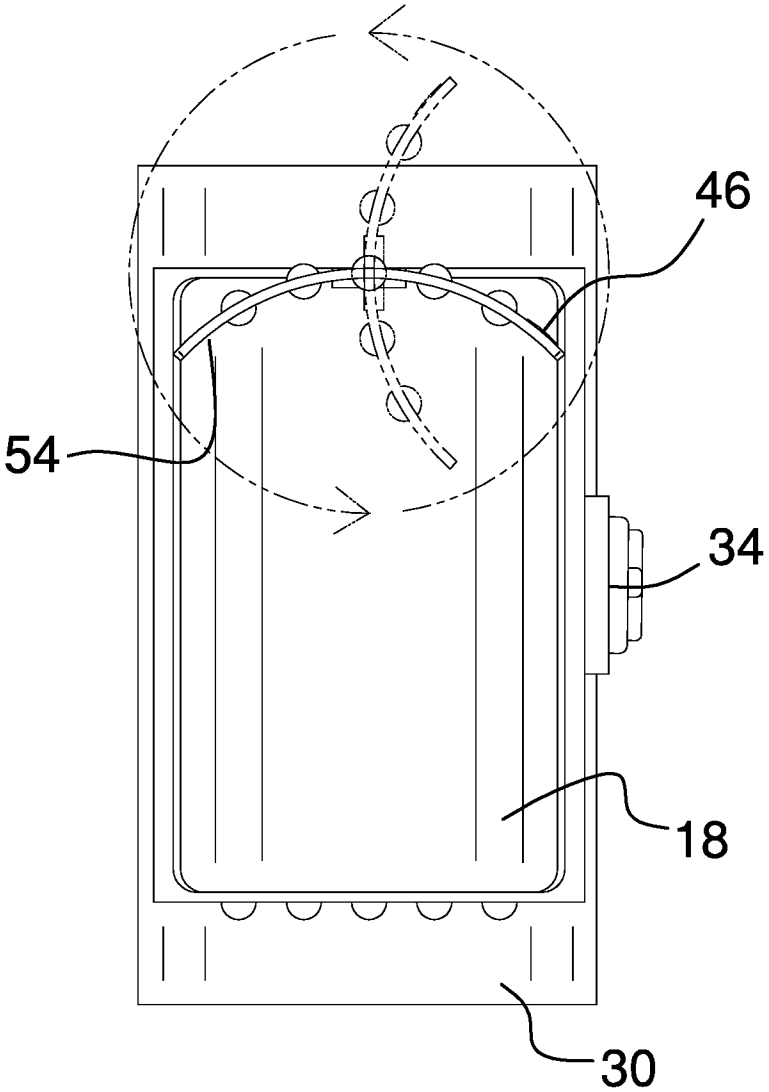
FIG. 7 is an in-use view of an embodiment of the disclosure.
Figure 8:
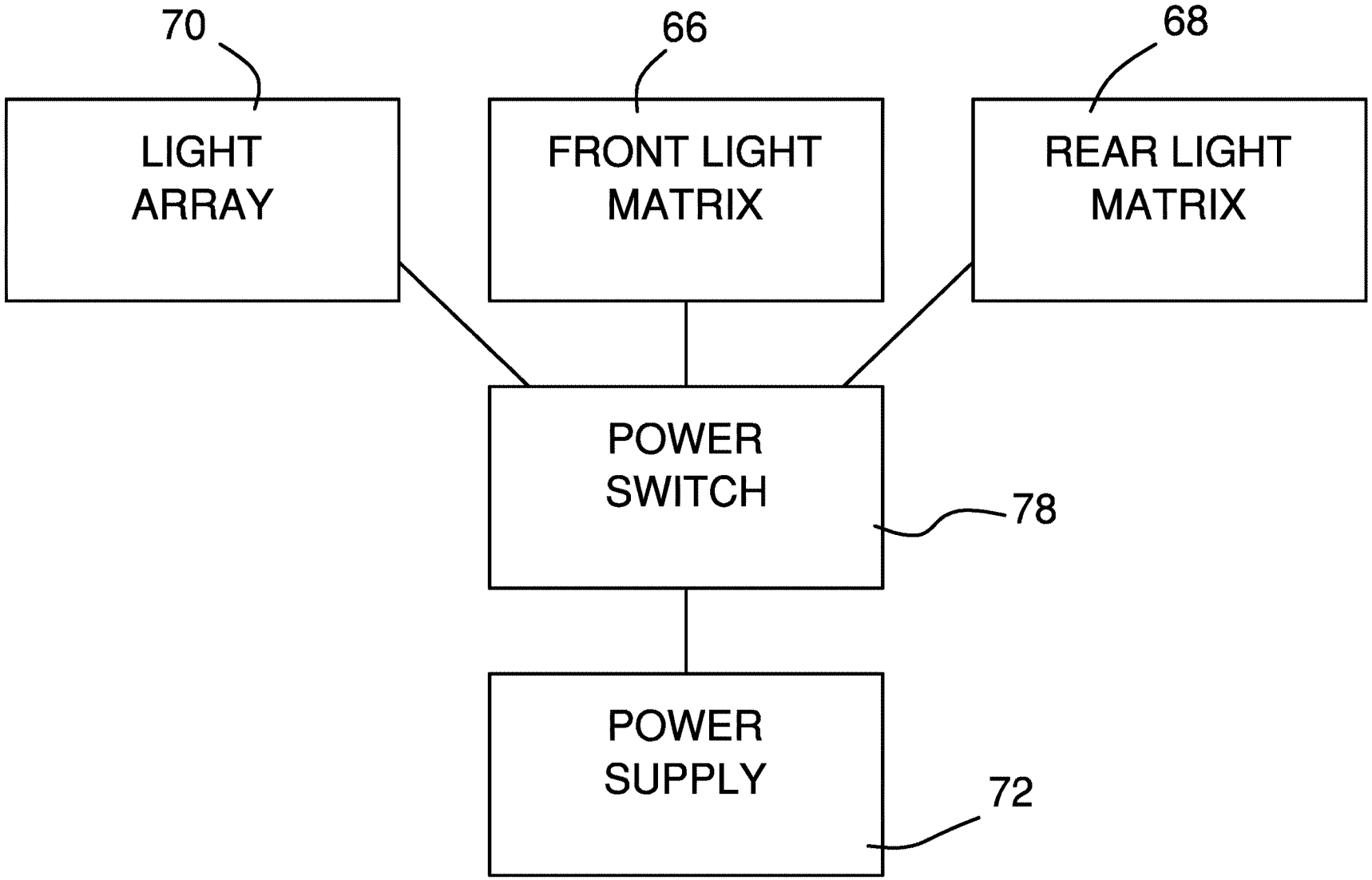
FIG. 8 is a block diagram of an embodiment of the disclosure.

With reference now to the drawings, and in particular to FIGS. 1 through 8 thereof, a new flashlight embodying the principles and concepts of an embodiment of the disclosure and generally designated by the reference numeral 10 will be described.

As best illustrated in FIGS. 1 through 8, the hands-free forearm flashlight 10 generally comprises a base 12 having a distal end 14, a proximal end 16, a dorsal side 18, a ventral side 20, a lateral side 22, and a medial side 24. Each of the proximal end 16 and the distal end 14 may be curved. The dorsal side 18 of the base may have a recession 26 extending from adjacent each of the proximal end 16, the distal end 14, the lateral side 22, and the medial side 24. The recession 26 forms a perimeter 28 and may have rounded corners. The base 12 is configured to conform to the curvature of a forearm of a user. An arm band 30 may be coupled to the ventral side 20 of the base. The arm band 30 is configured to selectively receive and secure the forearm of the user to provide added comfort and to secure the base 12. The arm band 30 may be a breathable rubber or elastic material such as, but not limited to, nylon or spandex. A strap 32 is coupled to the base 12 and extends from the lateral side 22 to the medial side 24 around the arm band 30. The strap 32 may have an adjustment mechanism 34. The adjustment mechanism 34 may be a ratchet mechanism 36 comprising a ratchet housing 38 and a dial knob 40 coupled to the ratchet housing 38. The dial knob 40 is rotatable to tighten and alternatively loosen the strap 32 to further secure the base 12 to the forearm of the user. The dial knob 40 may have a cross-shaped extrusion 42 to provide a leverage point for the user to turn the dial knob 40.

A hinge 44 is coupled to the proximal end 16 of the base adjacent the dorsal side 18. The hinge 44 may be pivotable. A light panel 46 has a front end 48, a rear end 50, a top side 52, a bottom side 54, a right side 56, and a left side 58. The light panel 46 may have rounded corners. The rear end 50 is coupled to the hinge 44 to allow the light panel 46 to swingably move between a closed position 60 touching the base 12 and an alternate open position 62 perpendicular to the base 12. The light panel 46 pivots relative the base 12 when in the alternate open position 62. The light panel 46 conforms to the curvature and the recession 26 of the base such that bottom side 54 rests flush with the dorsal side 18 of the base and the top side 52 rests flush with the perimeter 18 of the base when in the closed position 60.

A plurality of lights 64 is coupled to the light panel 46 and the base 12. The plurality of lights 64 comprises a front light matrix 66 coupled to the bottom side 54 of the light panel, a rear light matrix 68 coupled to the top side 52 of the light panel, and a light array 70 coupled to the distal end 14 of the base. A power supply 72 may comprise a rechargeable battery 74 and a charging port 76. The rechargeable battery 74 is coupled within the light panel 46 between the top side 52 and the bottom side 54 and the charging port 76 extends through top side 52 proximal the left side 58. The charging port 76 may be a USB port and is in operational communication with the rechargeable battery 74. The power supply 72 is in operational communication with the plurality of lights 64. A power switch 78 may comprise a recessed housing 80 coupled within the medial side 24 of the base and a slider 82 coupled within the recessed housing 80 such that the slider 82 is flush with the medial side 24 of the base. The power switch 78 is in operational communication with the power supply 72 and each of the front light matrix 66, the rear light matrix 68, and the light array 70. The power switch 78 separately activates and alternatively deactivates each of the front light matrix 66, the rear light matrix 68, and the light array 70. The power switch 78 may have an off position 84, a first alternate on position 86, a second alternate on position 88, and a third alternate on position 90. The off position 84 deactivates the plurality of lights 64 and the power supply 72. The first alternate on position 86 activates the light array 70 and the rear light matrix 68 to be used with the light panel 46 in the closed position 60. The second alternate on position 88 activates the light array 70 and the front light matrix 66 to be used with the light panel 46 in the alternate open position 62 to illuminate in the direction of the user's hand. The third alternate on position 90 activates the light array 70, the front light matrix 66, and the rear light matrix 68 to be used with the light panel 46 in the alternate open position 62.

In use, the arm band 30 and the strap 32 are used to secure the base 12 to the forearm of the user with the distal end 14 towards the user's hand. The plurality of lights 64 are then used to illuminate the user's surroundings by activating the power switch 78. The first alternate on position 86 may be used to illuminate tight spaces or the area immediately surrounding the user's hand, the second alternate on position 88 may be used for forward illumination, and the third alternate on position 90 may be used to maximize visibility for safety or in emergency situations.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

We claim:

1. A hands-free forearm flashlight comprising:

a base, the base having a distal end, a proximal end, a dorsal side, a ventral side, a lateral side, and a medial side;

a strap coupled to the base, the strap extending from the lateral side to the medial side, the strap being configured to secure the base to a forearm of a user;

a hinge coupled to the base, the hinge being coupled to the proximal end adjacent the dorsal side;

a light panel coupled to the hinge, the light panel having a front end, a rear end, a top side, a bottom side, a right side, and a left side, the rear end being coupled to the hinge, the light panel swingably moving between a closed position touching the base and an alternate open position perpendicular to the base;

a plurality of lights coupled to the light panel, the plurality of lights comprising a front light matrix coupled to the bottom side and a rear light matrix coupled to the top side;

a power supply coupled to the light panel, the power supply being coupled between the top side and the bottom side, the power supply being in operational communication with the plurality of lights; and a power switch coupled to the base, the power switch being in operational communication with the power supply and each of the front light matrix and the rear light matrix, the power switch separately activating and alternatively deactivating each of the front light matrix and the rear light matrix.

2. The hands-free forearm flashlight of claim 1 further comprising each of the proximal end and the distal end of the base being curved, the base being configured to conform to the curvature of the forearm of the user, the light panel conforming to the base such that the bottom side rests flush with the dorsal side when in the closed position.

3. The hands-free forearm flashlight of claim 2 further comprising the dorsal side of the base having a recession extending from adjacent each of the proximal end, the distal end, the lateral side, and the medial side, the recession forming a perimeter, the light panel conforming to the curvature and the recession such that the top side of the light panel rests flush with the perimeter when in the closed position.

4. The hands-free forearm flashlight of claim 3 further comprising each of the recession and the light panel having rounded corners.

5. The hands-free forearm flashlight of claim 1 further comprising the plurality of lights further comprising a light array coupled to the distal end of the base, the light array being in operational communication with each of the power supply and the power switch.

6. The hands-free forearm flashlight of claim 5 further comprising the power switch having an off position, an first alternate on position, an second alternate on position, and a third alternate on position, the off position deactivating the plurality of lights and the power supply, the first alternate on position activating the light array and the rear light matrix, the second alternate on position activating the light array and the front light matrix, and the third alternate on position activating the light array, the front light matrix, and the rear light matrix.

7. The hands-free forearm flashlight of claim 1 further comprising the strap having an adjustment mechanism, the adjustment mechanism tightening and alternatively loosening the strap.

8. The hands-free forearm flashlight of claim 7 further comprising the adjustment mechanism being a ratchet mechanism, the ratchet mechanism comprising a ratchet housing and a dial knob coupled to the ratchet housing, the dial knob being rotatable to tighten and alternatively loosen the strap.

9. The hands-free forearm flashlight of claim 8 further comprising the dial knob having a cross-shaped extrusion.

10. The hands-free forearm flashlight of claim 1 further comprising an arm band coupled to the base, the arm band being coupled to the ventral side of the base, the arm band being configured to selectively receive and secure the forearm of the user.

11. The hands-free forearm flashlight of claim 1 further comprising the power switch being coupled to the medial side of the base.

12. The hands-free forearm flashlight of claim 11 further comprising the power switch comprising a recessed housing and a slider coupled within the recessed housing, the slider being flush with the medial side of the base.

13. The hands-free forearm flashlight of claim 1 further comprising the power supply comprising a rechargeable battery and a charging port, the rechargeable battery being coupled within the light panel between the top side and the bottom side and the charging port extending through top side proximal the left side.

14. The hands-free forearm flashlight of claim 1 further comprising the hinge being pivotable, the light panel thus pivoting relative the base when in the alternate open position.

15. A hands-free forearm flashlight comprising:

a base, the base having a distal end, a proximal end, a dorsal side, a ventral side, a lateral side, and a medial side, each of the proximal end and the distal end being curved, the dorsal side of the base having a recession extending from adjacent each of the proximal end, the distal end, the lateral side, and the medial side, the recession forming a perimeter, the recession having rounded corners, the base being configured to conform to the curvature of a forearm of a user;

an arm band coupled to the base, the arm band being coupled to the ventral side of the base, the arm band being configured to selectively receive and secure the forearm of the user;

a strap coupled to the base, the strap extending from the lateral side to the medial side around the arm band, the strap having an adjustment mechanism, the adjustment mechanism being a ratchet mechanism, the ratchet mechanism comprising a ratchet housing and a dial knob coupled to the ratchet housing, the dial knob being rotatable to tighten and alternatively loosen the strap, the dial knob having a cross-shaped extrusion, the strap being configured to secure the base to the forearm of the user;

a hinge coupled to the base, the hinge being coupled to the proximal end adjacent the dorsal side, the hinge being pivotable;

a light panel coupled to the hinge, the light panel having a front end, a rear end, a top side, a bottom side, a right side, and a left side, the light panel having rounded corners, the rear end being coupled to the hinge, the light panel swingably moving between a closed position touching the base and an alternate open position perpendicular to the base, the light panel pivoting relative the base when in the alternate open position, the light panel conforming to the curvature and the recession of the base such that bottom side rests flush with the dorsal side of the base and the top side rests flush with the perimeter of the base when in the closed position;

a plurality of lights coupled to the light panel and the base, the plurality of lights comprising a front light matrix coupled to the bottom side of the light panel, a rear light matrix coupled to the top side of the light panel, and a light array coupled to the distal end of the base;

a power supply coupled to the light panel, the power supply comprising a rechargeable battery and a charging port, the rechargeable battery being coupled within the light panel between the top side and the bottom side and the charging port extending through top side proximal the left side the power supply being in operational communication with the plurality of lights; and a power switch coupled to the base, the power switch comprising a recessed housing coupled within the medial side of the base and a slider coupled within the recessed housing, the slider being flush with the medial side of the base, the power switch being in operational communication with the power supply and each of the front light matrix, the rear light matrix, and the light array, the power switch separately activating and alternatively deactivating each of the front light matrix, the rear light matrix, and the light array, the power switch having an off position, an first alternate on position, an second alternate on position, and a third alternate on position, the off position deactivating the plurality of lights and the power supply, the first alternate on position activating the light array and the rear light matrix, the second alternate on position activating the light array and the front light matrix, and the third alternate on position activating the light array, the front light matrix, and the rear light matrix.

* * * * *